US010233819B2

(12) United States Patent
Darling et al.

(10) Patent No.: US 10,233,819 B2
(45) Date of Patent: Mar. 19, 2019

(54) DUAL-PIVOT HINGE FOR FAN

(71) Applicants: Serena M. Darling, Dubuque, IA (US); Robert Meyer, Dubuque, IA (US)

(72) Inventors: Serena M. Darling, Dubuque, IA (US); Robert Meyer, Dubuque, IA (US)

(73) Assignee: Deere & COMPANY, Moline, IL (US)

( * ) Notice: Subject to any disclaimer, the term of this patent is extended or adjusted under 35 U.S.C. 154(b) by 1672 days.

(21) Appl. No.: 13/886,729

(22) Filed: May 3, 2013

(65) Prior Publication Data

US 2014/0329451 A1 Nov. 6, 2014

(51) Int. Cl.
*F01P 1/06* (2006.01)
*F01P 5/02* (2006.01)

(52) U.S. Cl.
CPC ..... *F01P 5/02* (2013.01)

(58) Field of Classification Search
CPC ..... B01D 46/26; B60H 2003/0666; B60H 3/0616; F01P 5/02
USPC ..... 180/68.1, 68.4; 55/385.3, 433, 480, 493; 454/143; 16/221, 365–370
See application file for complete search history.

(56) References Cited

U.S. PATENT DOCUMENTS 3,043,390 A * 7/1962 Lattay ..... B60K 11/08 123/41.49
3,619,853 A 1/1969 Merrill
3,600,742 A * 8/1971 Barger ..... E05D 3/12 16/366
4,242,773 A * 1/1981 Beigh ..... E05D 3/12 16/371
4,503,582 A 3/1985 Gurubatham
4,514,201 A * 4/1985 Brown ..... B01D 46/26 180/68.1
5,282,293 A * 2/1994 Pedoeem ..... E05D 3/12 16/342
5,622,404 A * 4/1997 Menne ..... A47C 4/52 297/188.1
5,685,046 A * 11/1997 Neag ..... E05D 3/127 16/334
6,997,504 B1 * 2/2006 Lang ..... E05D 3/127 16/334
7,032,953 B2 * 4/2006 Rangnekar ..... E05D 3/127 16/366
7,150,492 B2 * 12/2006 Nania ..... E05D 3/127 16/334
7,255,189 B2 * 8/2007 Kurtz, Jr. ..... B60K 11/04 123/41.43
7,753,152 B2 * 7/2010 Nakae ..... B60K 11/04 165/122

(Continued)

FOREIGN PATENT DOCUMENTS

EP 0556679 A1 8/1993
EP 1457627 B1 9/2004
GB 2212542 A * 7/1989 ..... E06B 5/025

OTHER PUBLICATIONS

Deere Skidders Product Brochure (22 pages)(Oct. 2012).

(Continued)

*Primary Examiner* — Kenneth Rinehart
*Assistant Examiner* — Phillip E Decker

(57) ABSTRACT

A system comprises a compartment, a fan, and a dual-pivot hinge. The compartment comprises an interior region and an access opening in communication with the interior region. The dual-pivot hinge mounts the fan to the compartment.

19 Claims, 12 Drawing Sheets

(56) References Cited

U.S. PATENT DOCUMENTS

| | | | | |
|---|---|---|---|---|
| 7,936,559 | B2 | 5/2011 | Chen | |
| 7,950,109 | B2 * | 5/2011 | Elliott | E05D 3/127 16/334 |
| 8,186,751 | B2 * | 5/2012 | Davisdon | B60R 19/52 296/193.1 |
| 8,197,567 | B2 * | 6/2012 | D'hondt | A01D 41/1252 460/100 |
| 8,363,171 | B2 | 1/2013 | Duchenne et al. | |
| 2007/0007061 | A1 | 1/2007 | Meyer et al. | |
| 2009/0106940 | A1 * | 4/2009 | Greenbank | E05D 3/127 16/367 |
| 2013/0068546 | A1 | 3/2013 | Neilson | |
| 2013/0099643 | A1 | 4/2013 | Kromrey et al. | |
| 2013/0153180 | A1 | 6/2013 | Montocchio et al. | |

OTHER PUBLICATIONS

Deere K-Series 92-147 kW Loaders Product Brochure (40 pages)(Mar. 2012).

Deere K-Series 173-283 kW Loaders Product Brochure (40 pages)(Feb. 2012).

* cited by examiner

DUAL-PIVOT HINGE FOR FAN

FIELD OF THE DISCLOSURE

The present disclosure relates to a system with a fan and a hinge for mounting the fan.

BACKGROUND OF THE DISCLOSURE

It is known for a cooling system of a work vehicle to have several coolers and a fan. The coolers are heat exchangers for cooling fluids of the work vehicle. The fan is used to induce an air flow across the coolers.

SUMMARY OF THE DISCLOSURE

According to an aspect of the present disclosure, a system comprises a compartment, a fan, and a dual-pivot hinge. The compartment comprises an interior region and an access opening in communication with the interior region.

The dual-pivot hinge mounts the fan to the compartment. The hinge comprises a first pivot unit defining a first pivot axis and a second pivot unit defining a second pivot axis. The first and second pivot axes are parallel to one another. The hinge is mounted to the compartment via the first pivot unit to pivot relative to the compartment about the first pivot axis. The fan is mounted to the hinge via the second pivot unit to pivot relative to the hinge about the second pivot axis. The fan is movable through the access opening between a closed position and an opened position upon pivoting of the hinge relative to the compartment about the first pivot axis and pivoting of the fan relative to the hinge about the second pivot axis. In the closed position, the fan is positioned within the interior region. In the opened position, the fan is positioned outside the interior region enabling access into the interior region through the access opening.

In an embodiment, the system comprises a cooler unit positioned within the interior region for cooling at least one fluid. In such a case, the fan is operable to induce an air flow across the cooler unit. In the closed position the fan is positioned within the interior region between the access opening and the cooler unit. In the opened position the fan is positioned outside the interior region enabling access through the access opening to the cooler unit positioned within the interior region, thereby facilitating, for example, clean-out of the cooler unit.

The above and other features will become apparent from the following description and the coupled drawings.

BRIEF DESCRIPTION OF THE DRAWINGS

The detailed description of the drawings refers to the accompanying figures in which.

DETAILED DESCRIPTION OF THE DRAWINGS

Figure 1:
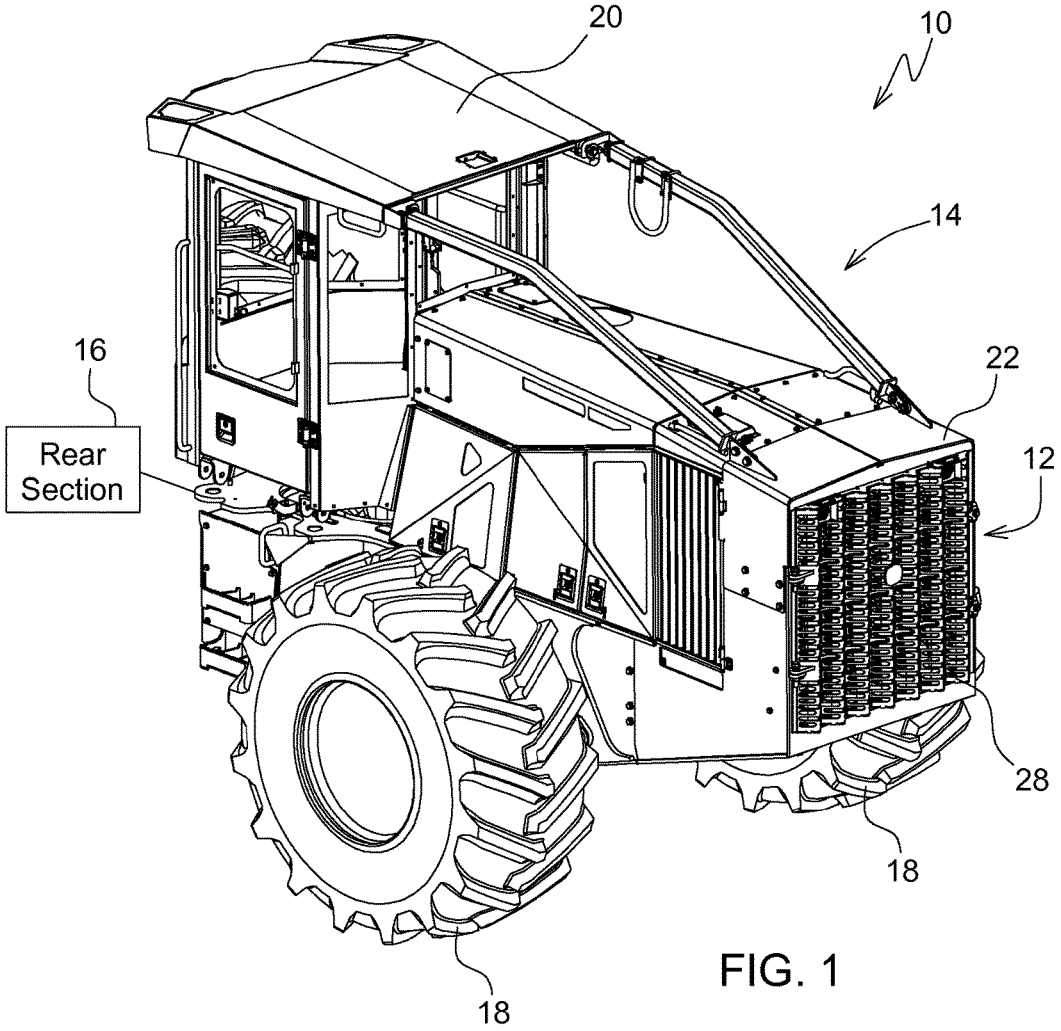
FIG. 1 is a front perspective view, with portions broken away, showing a work machine that comprises a cooling system.

Referring to FIG. 1, a work machine 10 comprises a cooling system 12 for cooling a number of fluids on board the machine 10. The work machine 10 may take the form of a wide variety of work machines with a cooling system. It is configured for example as a work vehicle, such as, for example, a construction, agricultural, or a turf vehicle, to name but a few.

Illustratively, the work machine 10 is a self-propelled forestry skidder comprising a front section 14 and a rear section 16, the front and rear sections 14, 16 articulated to one for steering of the machine 10. The front section 14 comprises traction elements 18 (e.g., each a ground-engaging wheel the final drive of which is shown diagrammatically), the cooling system 12, an operator's station 20 from which a human operator can control the machine 10, and an engine (not shown) in front of the operator's station 20. The rear section 16 (shown diagrammatically) comprises traction elements (e.g., ground-engaging wheels), an arch mounted pivotally to a frame of the rear section 16, a boom mounted pivotally to the arch, a work tool (e.g., a grapple or a cable) for manipulated one or more felled trees or logs, a pair of hydraulic cylinders for pivoting the arch relative to the frame, and a pair of hydraulic cylinders for pivoting the boom relative to the arch.

Figure 2:
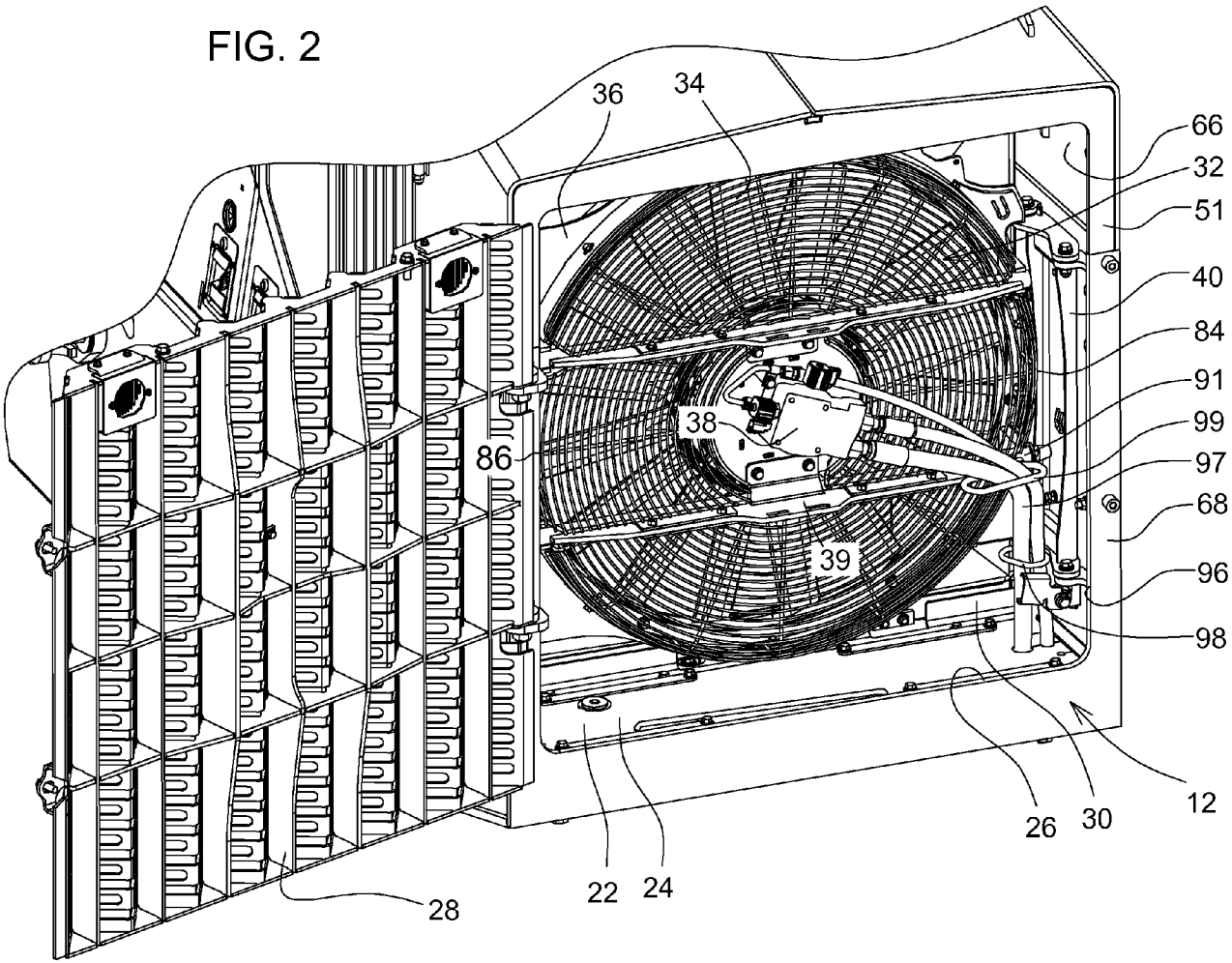
FIG. 2 is a front perspective view showing a fan of the cooling system, the fan mounted within an interior region of a compartment of the cooling system by use of a dual-pivot hinge and positioned in a closed position.
Figure 3:
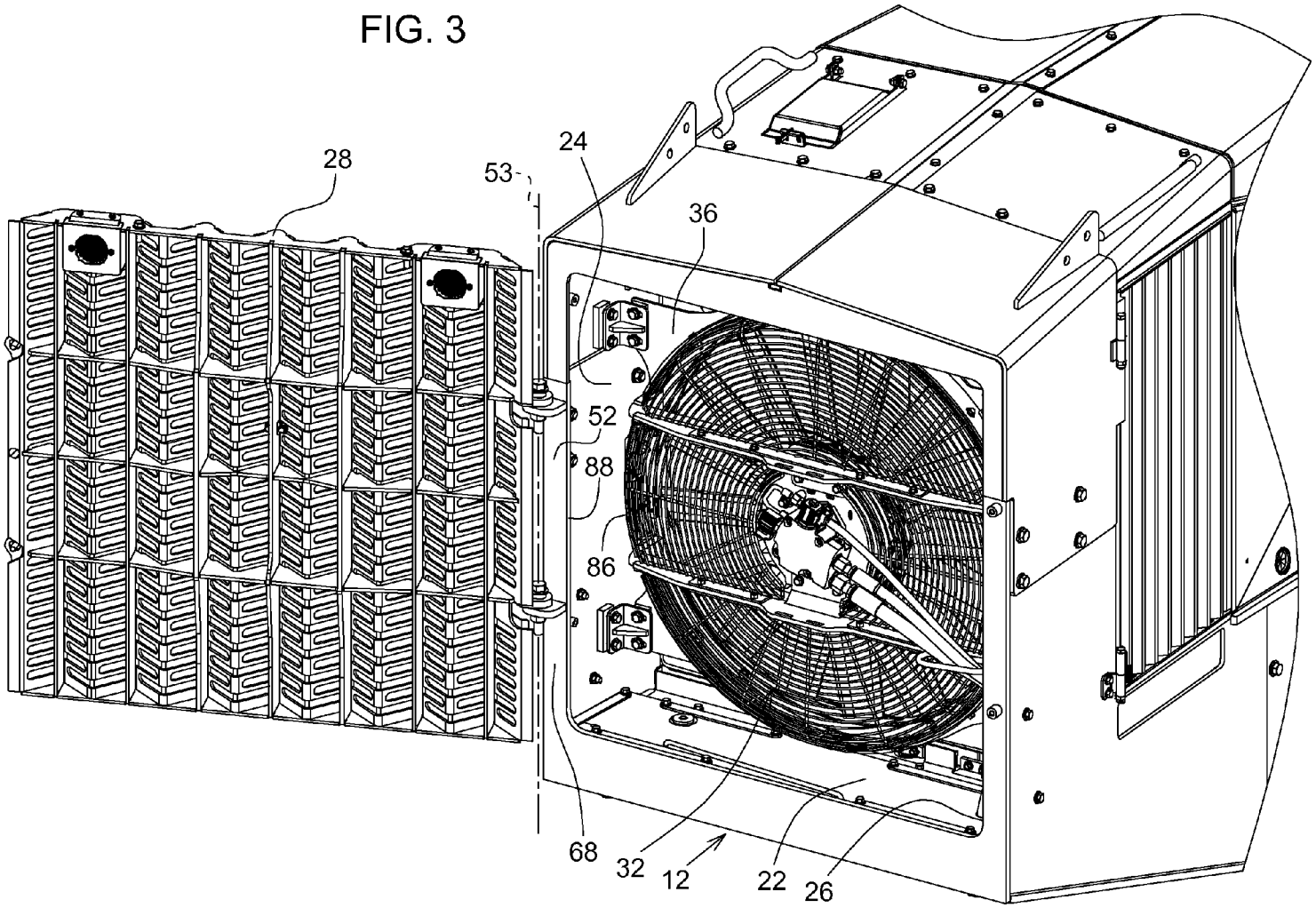
FIG. 3 is a front perspective view showing the fan positioned in its closed position.
Figure 4:
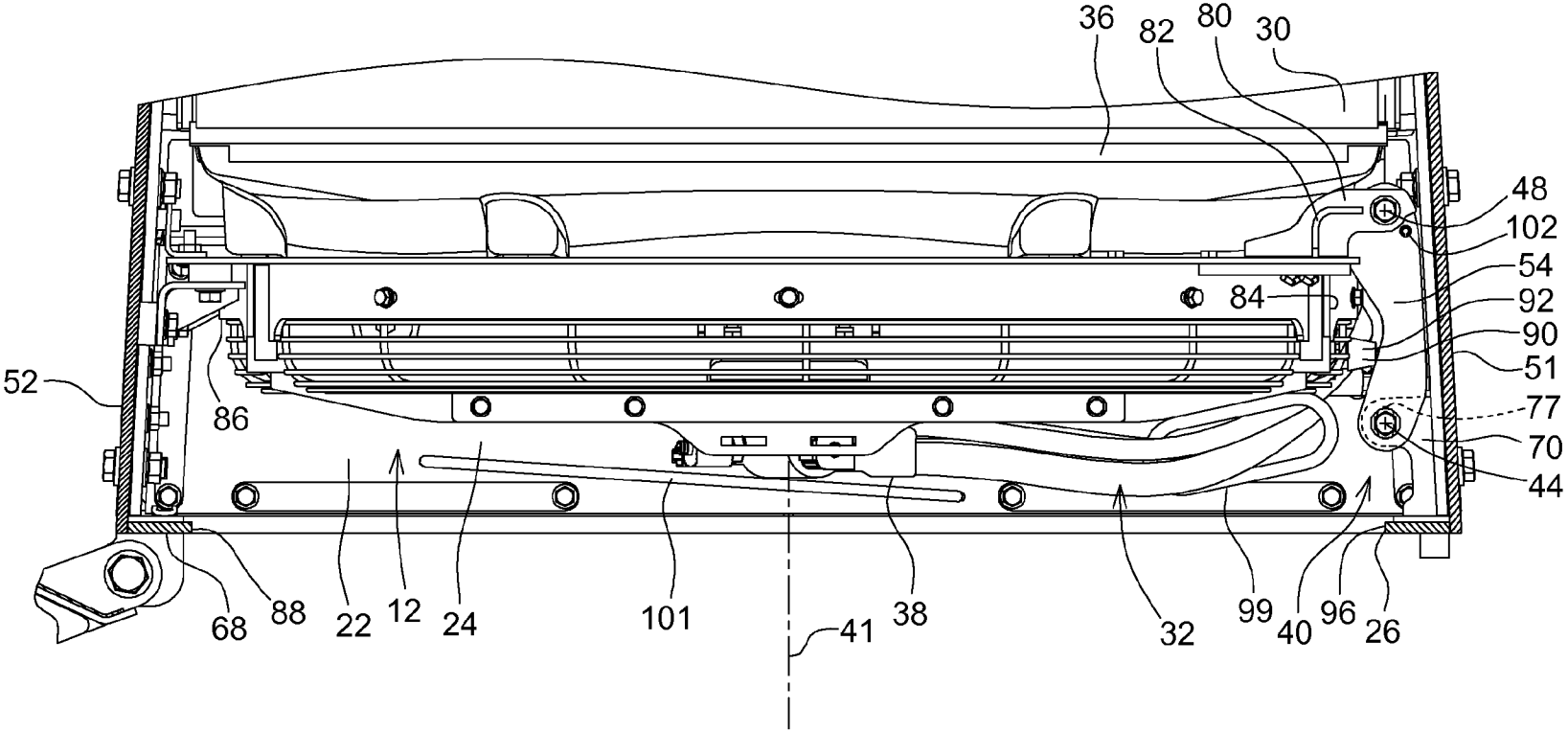
FIG. 4 is a top view showing the interior region of the compartment.

Referring to FIGS. 2-4, the cooling system 12 comprises a compartment 22. The compartment 22 comprises an interior region 24, an access opening 26 in communication with the interior region 24, and a grill 28 covering the access opening 26 when the grill 28 is positioned in a closed, use position (FIG. 1).

The cooling system 12 comprises a cooler unit 30 (which may also be referred to as a heat exchanger unit). The cooler unit 30 is positioned within the interior region 24 for cooling at least one fluid of the work machine 10. The cooler unit 20 may comprise a number of coolers (each of which may be referred to as a heat exchanger), such as, for example, a single cooler or more than one cooler. In the skidder example, the cooler unit 30 comprises a radiator (for engine coolant), a charge-air cooler, a hydraulic oil cooler, and a transmission oil cooler, and they are shown semi-diagrammatically for ease of illustration (i.e., their fins and tubes are not shown).

The cooling system 12 comprises a fan 32 operable to induce an air flow across the cooler unit 30 to cool the fluid(s). During normal operation, the fan 32 draws ambient air into the compartment 22 via, for example, holes in opposite side portions of the compartment 22 through the cooler unit 30 and out the front of the machine 10 through the access opening 26 and the grill 28. The fan 32 may be operated in reverse.

The fan 32 comprises, for example, a blade unit 34, a fan shroud 36, a fan motor 38, and a motor support 39. The blade unit 34 is mounted to the fan shroud 36 for rotation therein about a fan axis 41, and comprises a number of blades. The fan axis 41 is horizontal when the machine 10 is on level ground. The motor support 39 is mounted to the fan shroud 36. The fan motor 38 is mounted to the motor support 39. The fan motor 38 is attached operatively to the blade unit 34 to rotate the blade unit 34 about the fan axis.

Figure 5:
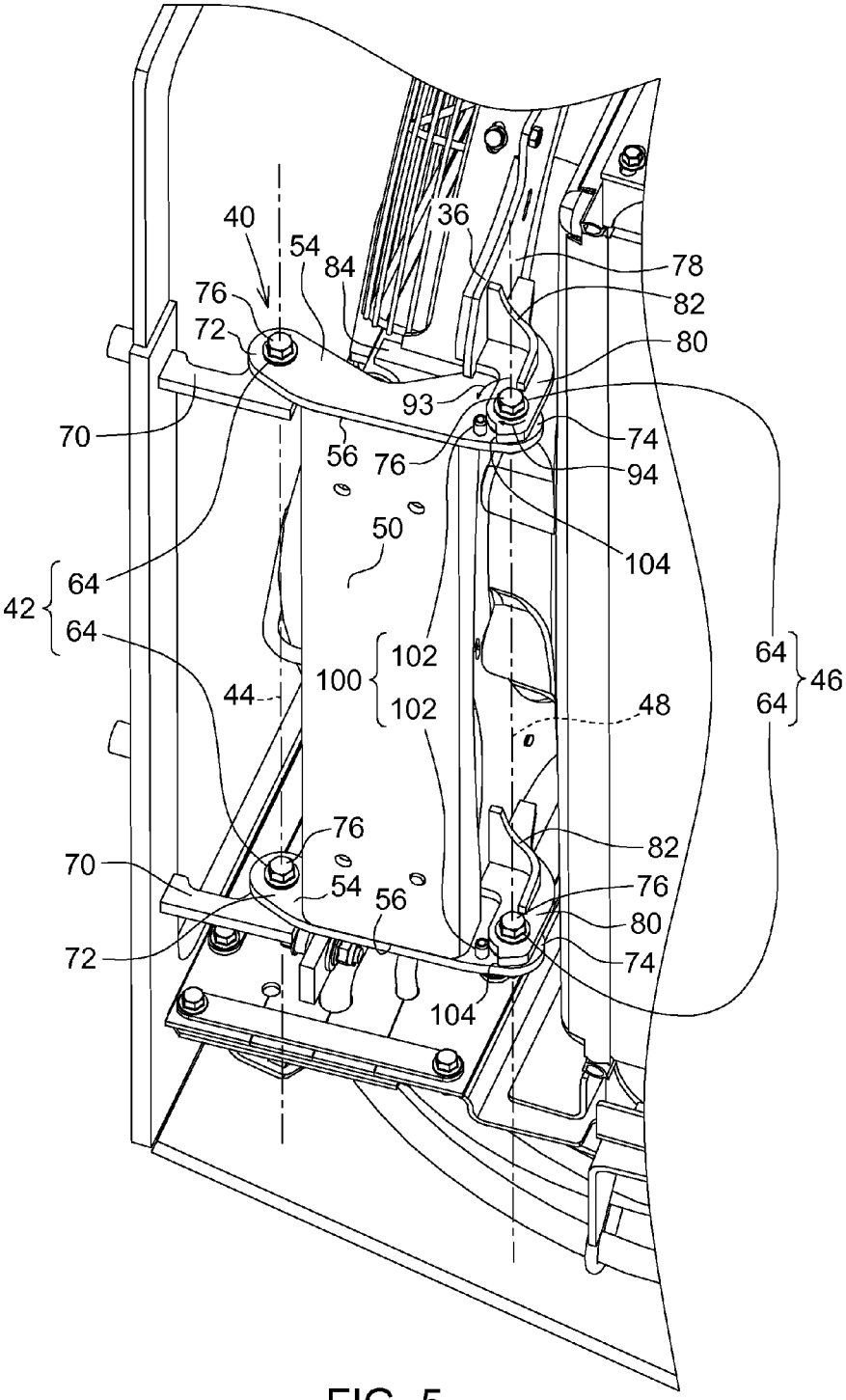
FIG. 5 is a left side perspective view, with portions broken away, showing the hinge.
Figure 6:
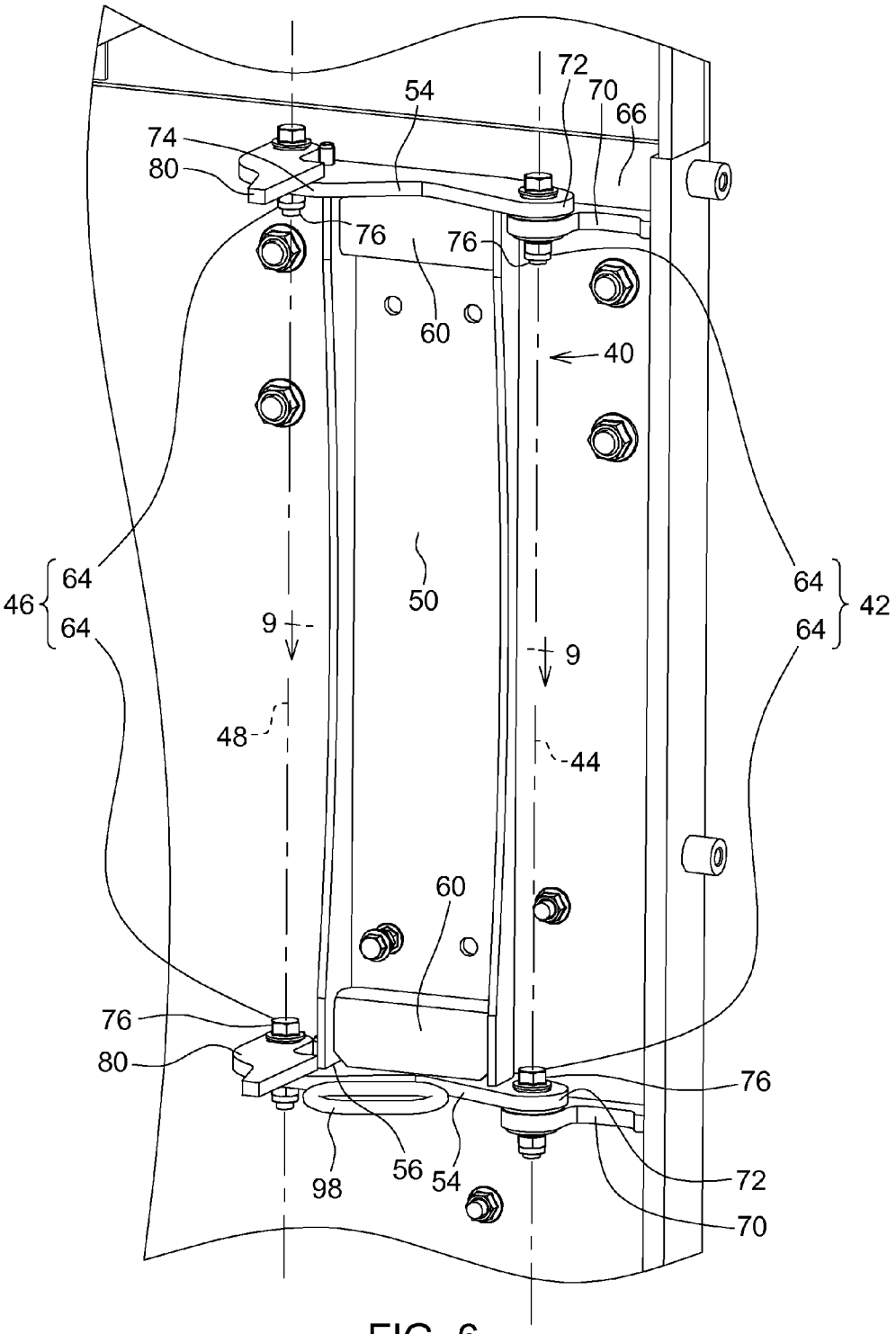
FIG. 6 is an elevation view showing the hinge.

Referring to FIGS. 4-6, the cooling system 12 comprises a dual-pivot hinge 40. The hinge 40 mounts the fan 32 to the compartment 22. The hinge comprises a first pivot unit 42 defining a first pivot axis 44 and a second pivot unit 46 defining a second pivot axis 48. The first and second pivot axes 44, 48 are parallel to one another, and vertical when the machine 10 is on level ground. The pivot axes 44, 48 are perpendicular to the fan axis 41 (at right angles, although non-intersecting). The hinge 40 is mounted to the compartment 22 via the first pivot unit 42 to pivot relative to the compartment 22 about the first pivot axis 44. The fan 32 is mounted to the hinge 40 via the second pivot unit 46 to pivot relative to the hinge 40 about the second pivot axis 48. The fan 32 is movable through the access opening 26 between a closed position and an opened position upon pivoting of the hinge 40 relative to the compartment 22 about the first pivot axis 44 and pivoting of the fan 32 relative to the hinge 40 about the second pivot axis 48. The fan 32 can thus swing between the closed and opened positions.

In the closed position (FIGS. 2-4), the fan 32 is positioned within the interior region 24 between the access opening 26 and the cooler unit 30 for use of the fan 32 to induce an air flow across the cooler unit 30. The first and second pivot units 42, 46 are positioned within the interior region 24.

In the opened position (FIGS. 10-12), the fan 32 is positioned outside the interior region 24 enabling access into the interior region through the access opening 26. The fan 32 is so positioned enabling access through the access opening 26 to the cooler unit 30 positioned within the interior region 24 so that, for example, the cooler(s) of the cooler unit 30 can be cleaned. Exemplarily, the fan 32 is positioned exterior to the machine 10, completely outside the interior region 24. The first pivot unit 42 is positioned within the interior region 24, and the second pivot unit 46 is positioned outside the interior region 24.

The compartment 22 comprises a first side portion 51 and a second side portion 52 opposite to the first side portion 51 relative to the access opening 26. The hinge 40 is mounted to the first side portion 51 via the first pivot unit 42. The grill 28 is mounted to the second side portion 52 to pivot relative to the compartment 22 about a third pivot axis 53.

Illustratively, the hinge 40 comprises a bracket 50, an upper mounting plate 54, and a lower mounting plate 54. The bracket 50 is oriented vertically in its longitudinal dimension, and is configured, for example, as a channel (i.e., a metal bar of flattened U-shaped section). A bolt may be threadedly mounted to a spine of the bracket 50, as show, for example, in FIG. 6 towards the bottom of the bracket 50. During assembly of the machine 10, the bolt may be positioned in contact with a side wall 66 of the compartment, and the extent to which the bolt extends through the spine may be adjusted to help establish suitable lateral positioning of the fan shroud 36 in the compartment 22 relative to a fore-aft dimension of the machine 10.

The upper and lower mounting plates 54 are mounted to the bracket 50. The upper and lower mounting plates 54 are spaced apart from one another vertically, and mounted (e.g., welded) respectively to an upper end edge 56 of the bracket 50 and a lower end edge 56 of the bracket 50.

An upper gusset 60 and a lower gusset 60 reinforce mounting of the upper mounting plate 54 and the lower mounting plate 54, respectively. Each gusset 60 is configured, for example, as an L-shaped plate attached (e.g., welded) to the bracket 50 (e.g., each of the three walls of the U-shaped section of the bracket 50) and to the respective mounting plate 54.

The first pivot unit 42 is attached to the compartment 22 and the hinge 40. The first pivot unit 42 comprises an upper pivot 64 and a lower pivot 64. The upper and lower pivots 64 of the first pivot unit 42 cooperate to define the first pivot axis 44.

The compartment 22 comprises a side wall 66 of the first side portion 51, a closed-loop grill housing or rim wall 68 that defines the access opening 26, an upper support plate 70, and a lower support plate 70. The upper and lower support plates 70 are mounted (e.g., welded) to the side wall 66 and an interior portion of the grill housing 68 included in the first side portion 51.

The grill 28 is mounted pivotally to an exterior portion of the grill housing 68 included in the second side portion 52. When the grill 28 is closed, it is fastened to a portion of the grill housing 68 included in the first side portion 51. The grill 28 can be opened by unfastening the grill 28 from that portion of the grill housing 68 included in the first side portion 51. The cooler(s) of the cooler unit 30 are positioned inboard of the grill housing 68 (e.g., 14.26 inches).

Each of the upper and lower mounting plates 54 comprises a first ear 72 and a second ear 74. The first and second ears 72, 74 are positioned laterally outboard of the bracket 50 relative to a lateral dimension of the bracket 50.

The first pivot unit 42 is attached to the upper and lower support plates 70 and to the upper and lower mounting plates 54. The upper pivot 64 of the first pivot unit 42 is attached to the upper support plate 70 and to the upper mounting plate 54 (e.g., to the first ear 72 of the upper mounting plate 54). The lower pivot 64 of the first pivot unit 42 is attached to the lower support plate 70 and to the lower mounting plate 54 (e.g., the first ear 72 of the lower mounting plate 54).

Each pivot 64 of the first pivot unit 46 comprises an axle 76 (e.g. a cap screw), a bushing, a washer spring, a washer, and a nut. With respect to each pivot 64 of the first pivot unit 42, the axle 76 extends downwardly from its head through the bushing positioned within a round hole of the first ear 72 of the respective mounting plate 54 atop the respective support plate 70 (so as to extend through that ear 72), the washer spring positioned vertically between the first ear 72 and the support plate 70, an elongated slot 77 of the support plate 70 (FIGS. 4 and 12), the washer positioned vertically between the support plate 70 and the nut, and the nut threaded onto the axle 76 against the washer so as to sandwich the washer between the nut and the support plate 70 and tighten the head of the axle 76 against the bushing. The washer spring would take up the gap between the mounting plate 54 and the support plate 70 (for ease of illustration the washer springs are represented as flat round washers centered on the axis 44 in FIG. 6 to the extent visible). The elongated slot 77 allows adjustment of the fit of the fan shroud 36 in the machine 10 during assembly of the machine 10.

The second pivot unit 46 is attached to the hinge 40 and the fan 32. The second pivot unit 42 comprises an upper pivot 64 and a lower pivot 64. The upper and lower pivots 64 of the second pivot unit 46 cooperate to define the second pivot axis 48.

The shroud 36 comprises a fan support plate 78, an upper tang 80, and a lower tang 80. The upper and lower tangs 80 are mounted (e.g., welded) to the fan support plate 78. The lower tang 80 is received in a notch formed in a bottom edge of the fan support plate 78.

The shroud 36 comprises an upper gusset 82 and a lower gusset 82. The upper and lower gussets 82 reinforce mounting of the upper tang 80 and the lower tang 80, respectively. Each gusset 82 is attached (e.g., welded) to the fan support plate 78 and the respective tang 80.

The second pivot unit 46 is attached to the upper and lower mounting plates 54 and to the upper and lower tangs 80. The upper pivot 64 of the second pivot unit 46 is attached to the upper mounting plate 54 (e.g., to the second ear 74 of the upper mounting plate 54) and to the upper tang 80. The lower pivot 64 of the second pivot unit 46 is attached to the lower support plate 70 (e.g., to the second ear 74 of the lower mounting plate 54) and to the lower tang 80. As such, a proximal side 84 of the fan 32 is attached to the second pivot unit 46, and a distal side 86 of the fan 32 is positioned farther from the second pivot unit 46 than the proximal side 84.

Each pivot 64 of the second pivot unit 46 comprises an axle 76 (e.g. a cap screw), a bushing, a washer spring, a washer, and a nut. With respect to each pivot 64 of the second pivot unit 46, the axle 76 extends downwardly from its head through the bushing positioned within a round hole of the respective tang 80 (so as to extend through that tang 80), the washer spring positioned vertically between the tang 80 and the second ear 74 of the respective mounting plate 54, a round hole of the second ear 74, the washer positioned vertically between the mounting plate 54 and the nut, and the nut threaded onto the axle 76 against the washer so as to sandwich the washer between the nut and the mounting plate 54 and tighten the head of the axle 76 against the bushing. The washer spring would take up the gap between the tang 80 and the mounting plate 54, and is represented as such with dashed lines only in FIG. 6 for ease of illustration. A small recess may be provided in the round hole of the tang 80 to aid in positioning the bushing into that hole (it is small in angular and radial extent with respect to the second pivot axis 48).

In the closed positioned, the fan 32 is secured to the compartment 22 against pivotal movement relative thereto about the first and second pivot axes 44, 48. The distal portion 86 of the fan 32, opposite to the hinge 40, is detachably fastened to the second side portion 52 of the compartment 22. The distal portion 86 comprises an upper bracket and a lower bracket, each of the upper bracket and the lower bracket fastened to the second side portion 52 by use of a number of fasteners (e.g., two cap screws).

Referring to FIGS. 2, 7-8, and 9-10, the fan 32 is pivotable about the first and second pivot axes 44, 48 in an opening direction from the closed position to the opened position. In a first phase of opening, the fan 32 pivots relative to the hinge 40 about the second pivot axis 48. The first phase continues until after the distal side 86 of the fan 32 exits the interior region 24 through the access opening 26 so as to clear the compartment 22, in particular, to clear an edge 88 of the second side portion 52 of the compartment 22 partially defining the access opening 26. The edge 88 is included in the grill housing 68.

Figure 9:
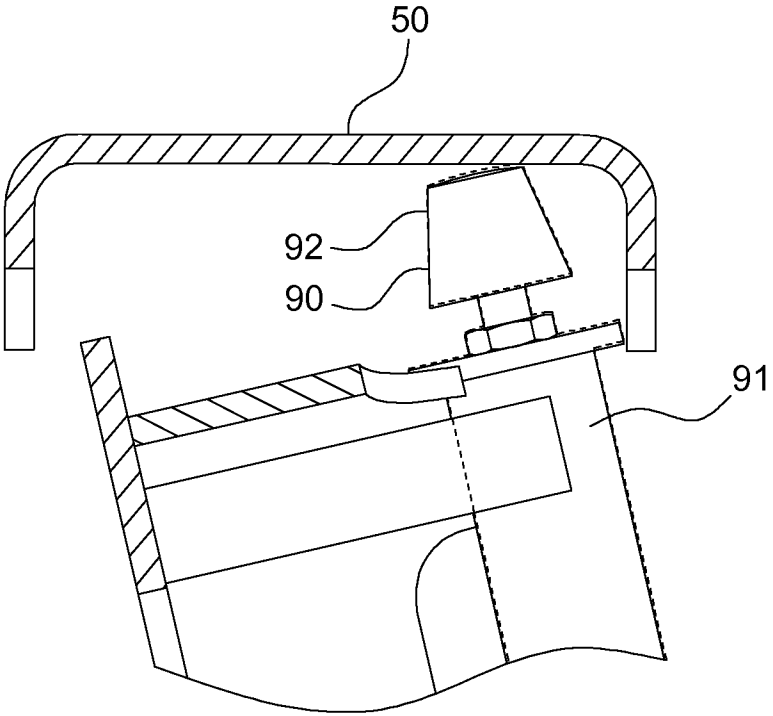
FIG. 9 is a sectional view, taken along lines 9-9 of FIG. 6, showing a pivot stop in solid in a first intermediate position corresponding to FIGS. 7 and 8 and showing the pivot stop in dashed lines in a second intermediate position contacting the hinge.
Figure 12:
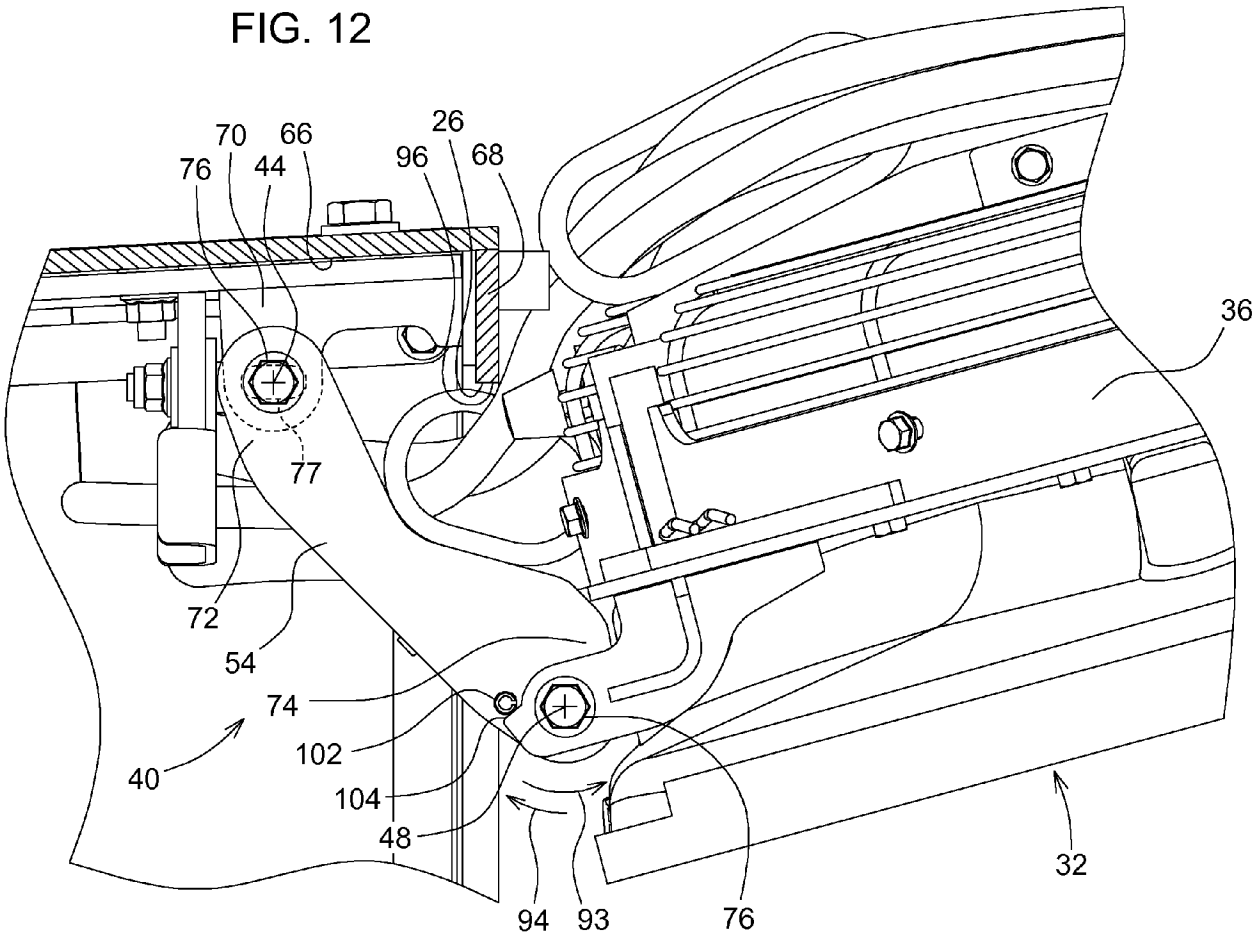
FIG. 12 is an enlarged top view, with portions broken away, of a region A of FIG. 11.

Referring to FIG. 9, a pivot stop 90 of the cooling system 12 may be used to end the first phase of opening and commence a second phase of opening. The pivot stop 90 is configured to stop pivoting of the fan 32 relative to the hinge 40 about the second pivot axis 48 in a first direction 93 (FIGS. 5 and 12). The pivot stop 90 is configured to do so after the distal side 86 of the fan 32 exits the interior region 24 through the access opening 26 so as to clear the compartment 22 and its edge 88.

The pivot stop 90 is mounted to the fan 32. The pivot stop 90 is mounted to the motor support 39. The motor support 39 comprises a horizontal round bar 91. The pivot stop 90 is mounted to an end of the bar 91.

The pivot stop 90 is configured to contact the hinge 40 to stop pivoting of the fan 32 about the second pivot axis 48 in the first direction 93. The pivot stop 90 comprises a generally frusto-conical bumper 92, a threaded post, a threaded disc, and a nut. The disk is welded to the end of the bar 91 and has a threaded hole in which the post is threaded. A nut is threaded on the post against the disk to secure the pivot stop 90 to the bar 91. The bumper 92 is made, for example, of a compressible material (e.g., rubber) and configured to contact the hinge 40. The bumper 92 of the pivot stop 90 is configured to contact the bracket 50 between the upper and lower mounting plates 54.

Figure 7:
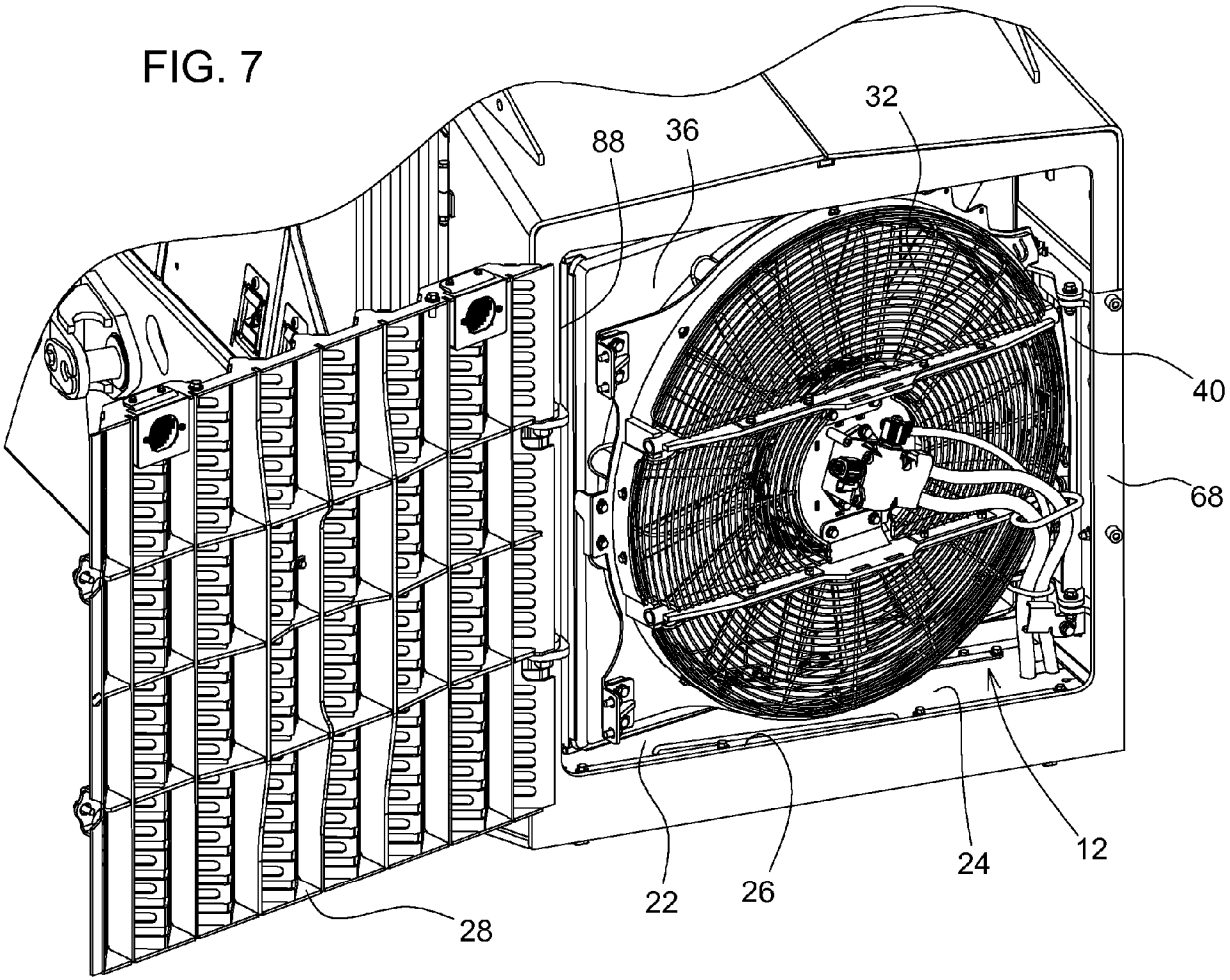
FIG. 7 is a front perspective view showing pivoting of the fan in an opening direction so that a side of the fan distal from the hinge clears the compartment.
Figure 8:
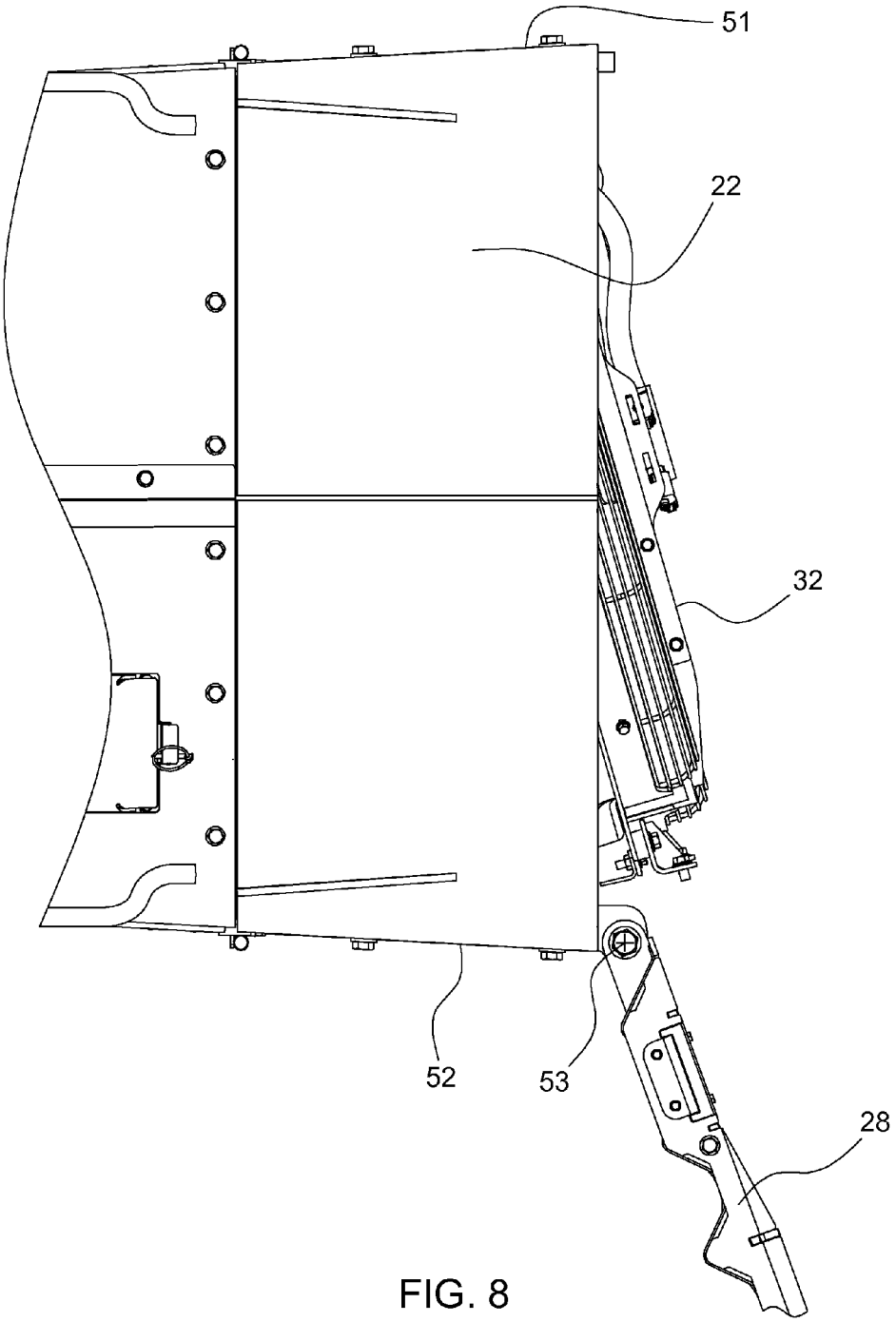
FIG. 8 is a top view showing the fan in the position of FIG. 7.

Referring to FIGS. 7-9, the fan 32 assumes an intermediate position when the distal side 86 of the fan 32 clears of the compartment 22, as signaled by contact between the pivot stop 90 and the hinge 40. The intermediate position is between the opened and closed positions. The fan 32 is shown in a corresponding intermediate position in FIGS. 7, 8, and in solid in FIG. 9. The pivot stop 90 contacts the hinge 40 upon pivoting of the fan 32 about the pivot axis 48 slightly farther away from the closed position, as represented in dashed lines in FIG. 9.

Opening of the fan 32 can enter a second phase after the fan 32 clears the compartment 22. In the second phase, the hinge 40, as well as the fan 32, pivots relative to the compartment 22 about the first pivot axis 44 to the opened position.

Opening of the fan 32 in the second phase may cause the fan 32 to pivot relative to the hinge 40 about the second pivot axis 48 in a second direction 94 opposite to the first direction 93 (FIGS. 5 and 12). Such pivoting of the fan 32 about the second pivot axis 48 in the second direction 94 tends to "straighten out" the fan 32 relative to hinge 40. A pivot stop 100 limits pivotal movement of the fan 32 relative to the hinge 40 about the second pivot axis 48 in the second direction 94, as discussed in more detail below.

Hosing 97 is coupled fluidly to the motor 38 and routed through a first guide loop 98 and a second guide loop 99 (FIG. 2). The hosing 97 comprises, for example, a supply hose, a return hose, and a case drain hose. The first guide loop 98 is mounted (e.g., welded) to the lower mounting plate 54, and may thus be considered as part of the hinge 40. The second guide loop 99 is mounted (e.g., welded) to the bar 91.

The hosing 97 provides resistance to pivotal movement of the fan 32 about the first pivot axis 44 when the fan 32 assumes the opened position. This resistance signals to the operator that the fan 32 has reached the opened position. The resistance from the hosing 97 thus establishes the location of the opened position with respect to the first pivot axis 44.

If the operator nevertheless forcefully pivots the fan 32 beyond the opened position so as to overcome the resistance of the hosing 97, the first guide loop 98 will contact an edge 96 included in the grill housing 68 and the first side portion 51 of the compartment 22, such edge 96 partially defining the access opening 26. The edge 96 may thus serve as another pivot stop configured to contact the hinge 40 and its first guide loop 98 to stop pivoting of the hinge 40 relative to the compartment 22 about the first pivot axis 44.

Figure 10:
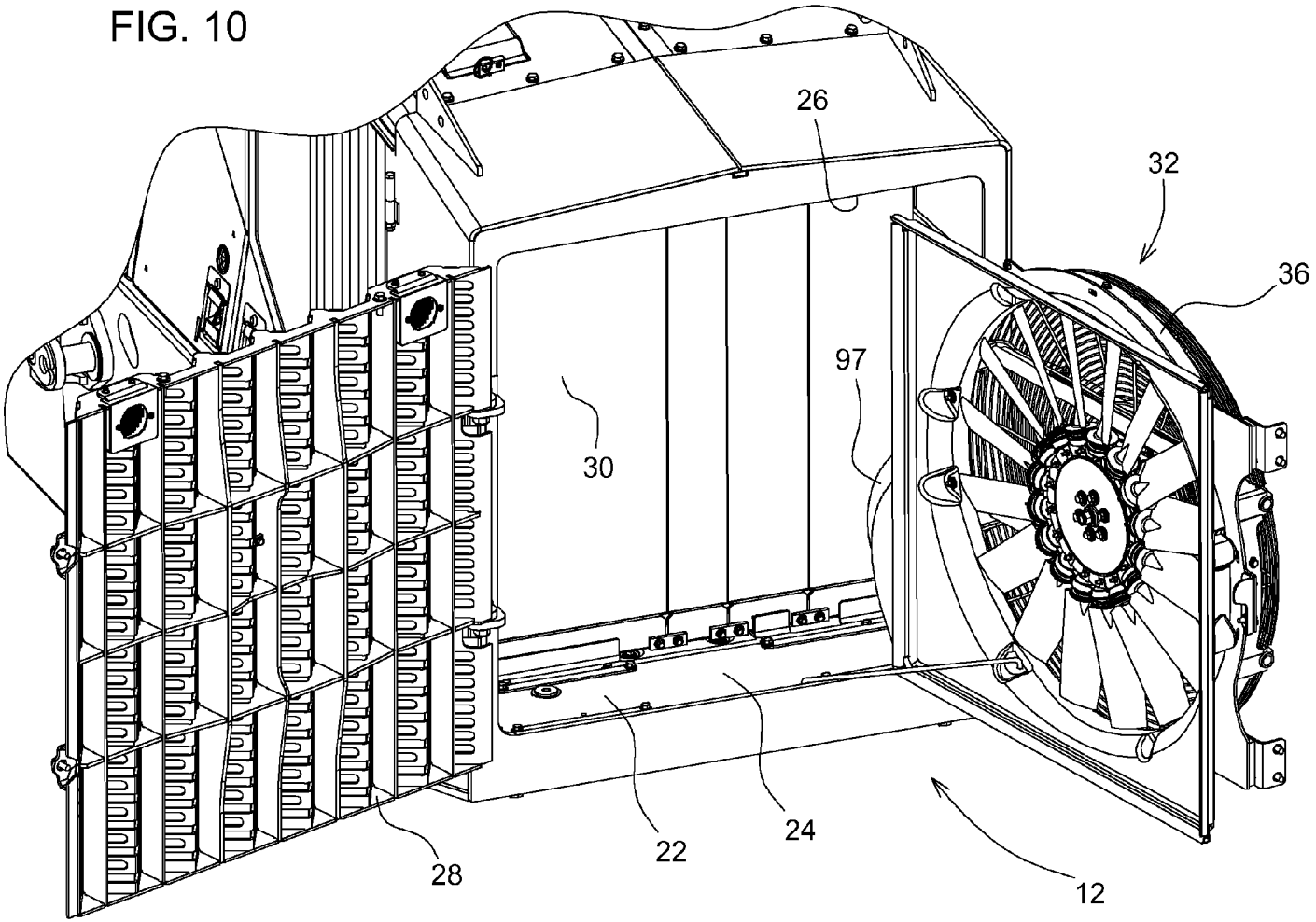
FIG. 10 is a perspective view showing the fan in an opened position.
Figure 11:
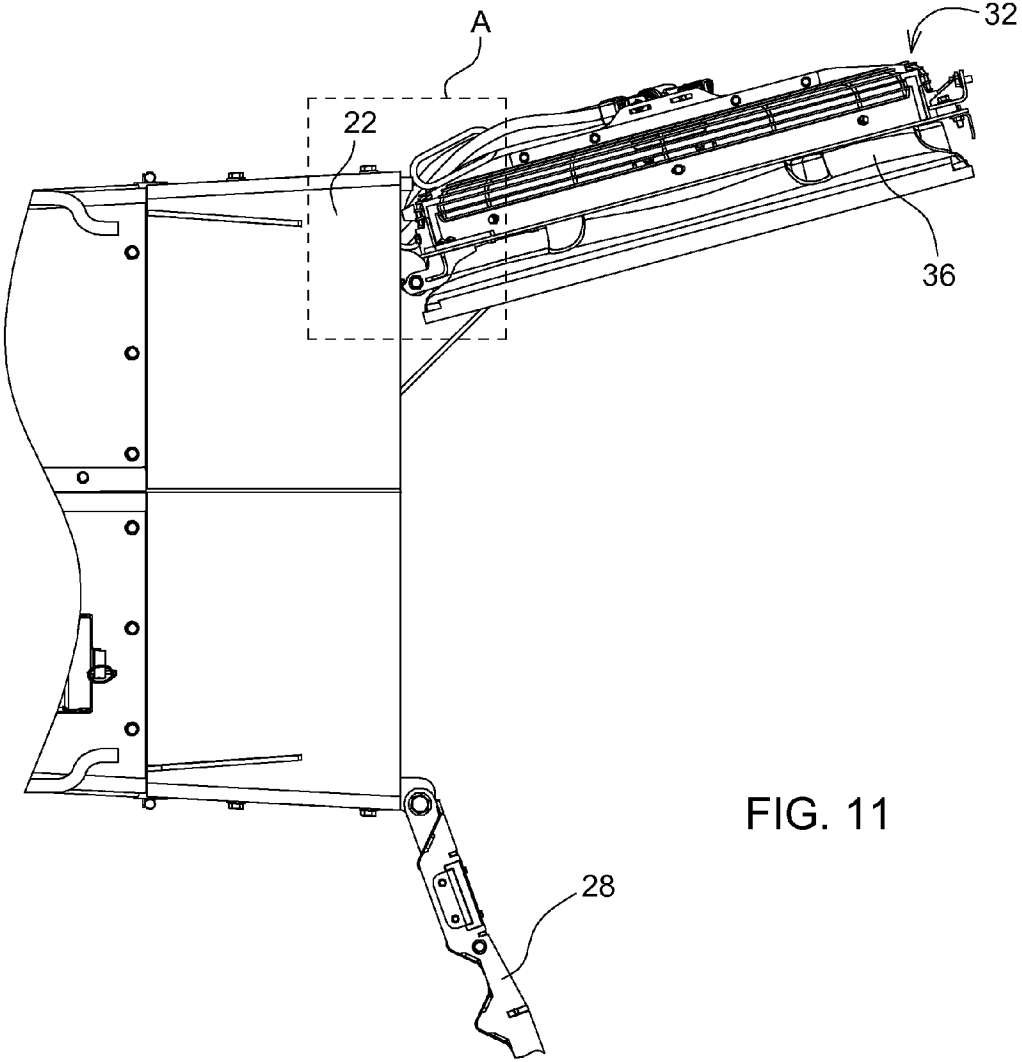
FIG. 11 is a top view showing the fan in the position of FIG. 10.

Referring to FIGS. 10-12, when the fan 32 is positioned in the opened position, a person has wide access through the access opening 26 to the cooler unit 30 positioned in the interior region 24. The fan 32 is swung out of the way to the cooler unit 30 and is clear of the grill housing 68. Such access to the cooler unit 30 facilitates ready and effective clean-out of the cooler(s) thereof, promoting adequate cleanliness of the cooler(s) of the cooler unit 30 and thus cooling effectiveness. A prop rod 101 may be used to prop open the fan 32 in its opened position. The fan 32 may thus be opened without having to unbolt and remove access panels and other neighboring components (aside from unfastening the grill 28 and the fan 32).

The fan 32 may be pivoted from its opened position back to its closed position in a reversal of the opening sequence described above. In so doing, pivotal movement of the fan 32 relative to the hinge 40 in the second direction 94 is limited.

Referring to FIGS. 5 and 12, the cooling system 12 comprises a pivot stop 100. The pivot stop 100 is mounted to the hinge 40 and configured to stop pivoting of the fan 32 relative to the hinge 40 about the second pivot axis 48 in the second direction 94. It does so to facilitate closing of the fan 32. In FIG. 12, the pivot stop 100 is shown engaged in the opened position. During closing of the fan 32, the pivot stop 100 engages so that the hinge 40 pivots with the fan 32 relative to the compartment 22 about the first pivot axis 44, preventing over-pivoting of the fan 32 relative to the hinge 40 about the second pivot axis 48 in the second direction 94. Such over-pivoting could interfere with closure of the fan 32 or result in an inefficient closing maneuver.

The pivot stop 100 comprises an upper post 102 and a lower post 102. The upper post 102 and the lower post 102 are mounted to and project vertically (e.g., upwardly) from the upper mounting plate 54 and the lower mounting plate 54, respectively. Each post 102 is configured, for example, as a split dowel pin pressed into a hole of the respective mounting plate 54.

Each of the upper and lower tangs 80 comprises a tab 104 projecting radially relative to the second pivot axis 48 such that the tang 80 changes in its radial extent by virtue of the tab 104. The tab 104 of the upper tang 80 is configured to pivot into contact with the upper post 102 such that the upper post 102 stops pivoting of the fan 32 relative to the hinge 40 about the second pivot axis 48 in the second direction 94. The tab 104 of the lower tang 80 is configured to pivot into contact with the lower post 102 such that the lower post 102 stops pivoting of the fan 32 relative to the hinge 40 about the second pivot axis 48 in the second direction 94.

When the fan 32 is re-positioned in its closed position, the distal portion 86 of the fan 32 is re-fastened to the second side portion 52 of the compartment 22. The fan 32 is thus re-secured in the closed position for use of the fan 32.

The cooling system 12 may be used with a wide variety of work vehicles or other work machines. For example, the cooling system 12 may be used on a wheeled feller buncher, to name but one other example.

No welds and fastener threads have been shown in the drawings for simplification of illustration, it being understood that it would be well within the skill of one of ordinary skill in the art to provide those features without undue experimentation.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the appended claims.

What is claimed is:

1. A system, comprising a compartment comprising an interior region and an access opening in communication with the interior region, a fan, and a dual-pivot hinge mounting the fan to the compartment, the hinge comprising a first pivot unit defining a first pivot axis and a second pivot unit defining a second pivot axis, the first and second pivot axes parallel to one another, the hinge mounted to the compartment via the first pivot unit to pivot relative to the compartment about the first pivot axis, the fan mounted to the hinge via the second pivot unit to pivot relative to the hinge about the second pivot axis, the fan movable through the access opening between a closed position and an opened position upon pivoting of the hinge relative to the compartment about the first pivot axis and pivoting of the fan relative to the hinge about the second pivot axis, wherein, in the closed position, the fan is positioned within the interior region, and, in the opened position, the fan is positioned outside the interior region enabling access into the interior region through the access opening, and wherein from the closed position to the opened position, pivoting of the fan relative to the hinge about the second pivot axis is prior to pivoting of the hinge relative to the compartment about the first pivot axis.

2. The system of claim 1, comprising a pivot stop configured to stop pivoting of the fan relative to the hinge about the second pivot axis in a direction.

3. The system of claim 2, wherein the fan comprises a proximal side attached to the second pivot unit and a distal side positioned farther from the second pivot unit than the proximal side, and the pivot stop is configured to stop pivoting of the fan relative to the hinge about the second pivot axis in the direction after the distal side exits the interior region through the access opening so as to clear the compartment.

4. The system of claim 2, wherein the pivot stop is mounted to the fan and configured to contact the hinge.

5. The system of claim 4, wherein the fan comprises a fan shroud, a fan motor, and a motor support mounted to the fan shroud, the fan motor is mounted to the motor support, and the pivot stop is mounted to the motor support.

6. The system of claim 5, wherein the motor support comprises a bar, and the pivot stop is mounted to an end of the bar.

7. The system of claim 5, wherein the pivot stop comprises a bumper configured to contact the hinge.

8. The system of claim 4, wherein the hinge comprises a bracket, an upper mounting plate, and a lower mounting plate, the bracket is oriented vertically in its longitudinal dimension and is configured as a channel, the upper and lower mounting plates are spaced apart from one another and mounted respectively to an upper end edge of the bracket and a lower end edge of the bracket, the first and second pivot units are attached to the upper and lower mounting plates, and the pivot stop is configured to contact the bracket between the upper and lower mounting plates.

9. The system of claim 8, comprising a post mounted to and projecting vertically from the upper mounting plate or the lower mounting plate, wherein the direction is a first direction, the fan comprises a tang through which an axle of the second pivot unit extends, and the tang is configured to pivot into contact with the post such that the post stops pivoting of the fan relative to the hinge about the second pivot axis in a second direction opposite to the first direction.

10. The system of claim 2, wherein the direction is a first direction, the system comprising another pivot stop mounted to the hinge and configured to stop pivoting of the fan relative to the hinge about the second pivot axis in a second direction opposite to the first direction.

11. The system of claim 1, comprising a pivot stop mounted to the hinge and configured to stop pivoting of the fan relative to the hinge about the second pivot axis.

12. The system of claim 1, wherein the hinge comprises a bracket, an upper mounting plate, and a lower mounting plate, the upper and lower mounting plates are mounted to the bracket, and each of the first and second pivot units is attached to the upper and lower mounting plates.

13. The system of claim 12, comprising hosing and an edge partially defining the access opening, wherein the hinge comprises a guide loop mounted to the lower mounting plate, the hosing is routed through the guide loop, and the edge is configured to contact the guide loop to stop pivoting of the hinge relative to the compartment about the first pivot axis.

14. The system of claim 12, wherein the upper and lower mounting plates are spaced apart from one another vertically and mounted respectively to an upper end edge of the bracket and a lower end edge of the bracket.

15. The system of claim 12, comprising a post, wherein the upper and lower mounting plates are spaced apart from one another vertically and mounted respectively to an upper end edge of the bracket and a lower end edge of the bracket, the post is mounted to and projects vertically from the upper mounting plate or the lower mounting plate, the fan comprises a tang through which an axle of the second pivot unit extends, and the tang comprises a tab projecting radially relative to the second pivot axis, the tab is configured to pivot into contact with the post such that the post stops pivoting of the fan relative to the hinge about the second pivot axis.

16. The system of claim 1, wherein, in the closed position, the first and second pivot units are positioned within the interior region, and, in the opened position, the first pivot unit is positioned within the interior region and the second pivot unit is positioned outside the interior region.

17. The system of claim 1, wherein, in the opened position, the fan is positioned completely outside the interior region.

18. The system of claim 1, comprising a grill, wherein the compartment comprises a first side portion and a second side portion opposite to the first side portion relative to the access opening, the hinge is mounted to the first side portion via the first pivot unit, and the grill is mounted to the second side portion to pivot relative to the compartment about a third pivot axis.

19. The system of claim 1, comprising a cooler unit positioned within the interior region for cooling at least one fluid, wherein the fan is operable to induce an air flow across the cooler unit, in the closed position the fan is positioned within the interior region between the access opening and the cooler unit, and in the opened position the fan is positioned outside the interior region enabling access through the access opening to the cooler unit positioned within the interior region.

* * * * *